US005837104A

United States Patent [19]

Suey

[11] Patent Number: 5,837,104

[45] Date of Patent: Nov. 17, 1998

[54] EXTENDERS FOR HOT FACE REFRACTORY OF COKE OVEN PUSHER SIDE DOOR

[76] Inventor: Paul V. Suey, 255 Green Parrot La., Natrona Heights, Pa. 15065

[21] Appl. No.: 677,575

[22] Filed: Jul. 8, 1996

[51] Int. Cl.[6] ..... C10B 1/06

[52] U.S. Cl. ..... 202/248; 202/242

[58] Field of Search ..... 202/242, 248

[56] References Cited

U.S. PATENT DOCUMENTS

| | | | |
|---|---|---|---|
| 4,217,177 | 8/1980 | Gerding et al. | 202/248 |
| 4,276,121 | 6/1981 | Rogers | 202/227 |
| 4,427,494 | 1/1984 | Naevestad | 202/248 |
| 4,647,342 | 3/1987 | Stog et al. | 202/242 |
| 4,676,873 | 6/1987 | Haaf et al. | 202/242 |
| 4,744,867 | 5/1988 | Suey | 202/248 |
| 4,793,900 | 12/1988 | Suey | 202/248 |
| 5,443,696 | 8/1995 | Baird et al. | 202/248 |

*Primary Examiner*—Edward J. Cain
*Attorney, Agent, or Firm*—Armstrong, Westerman, Hattori, McLeland & Naughton

[57] ABSTRACT

A pusher side coke oven door assembly comprises a door, a cold face refractory wall attached to the door, and a hot face refractory wall attached to and spaced from the cold face refractory wall to form therewith a hollow vent space for gases evolved from roasting coal, wherein a top section of the hot face refractory wall is L-shaped and has a horizontally-disposed leg extending across the hollow vent space, and a pair of extender plates mounted on the leg and extending vertically thereabove to prevent coal spillage and entry into the hollow vent space during coal levelling.

6 Claims, 3 Drawing Sheets

EXTENDERS FOR HOT FACE REFRACTORY OF COKE OVEN PUSHER SIDE DOOR

BACKGROUND

1. Field of the Invention

This invention relates to improvements in coke oven doors and, more specifically, to extenders mounted on the top of a hot face refractory wall at the pusher side of a coke oven door as shown in U.S. Pat. Nos. 4,744,867 and 4,793,900 to prevent coal from spilling over the top of the hot refractory wall during coal levelling.

2. Prior Art

Coke oven doors are constructed of metal and have a refractory lining facing inwardly of the oven to protect the metal door from the high temperatures prevalent during coking of coal charged into the oven. U.S. Pat. No. 4,744,867, granted to the inventor of this present invention, and incorporated herein by reference, is directed to a coke oven door refractory lining comprising a cold face refractory wall attached to a coke oven door, and a hot face refractory wall attached to and spaced from the cold face refractory wall with Z-shaped bar connectors, thus providing a hollow space between the refractory walls in which gases from burning coal can be vented, flowing vertically upwardly for removal from the top of the coke oven. In order to minimize, during leveling of coal in the coke oven, the coal from being raked into and plugging such hollow space between the refractory walls, a top section of the hot face refractory wall is L-shaped, having a horizontally-extending leg projecting across the hollow space to abut the top of the cold face refractory wall.

In practice of the invention of U.S. Pat. No. 4,744,867, it has been found that, despite such construction, during coal levelling, coal sometimes can spill over the L-shaped cap of the hot face refractory wall on the pusher side of the oven, with the result that such spilled coal intrudes into the hollow vent space between the cold face and hot face refractory walls.

SUMMARY OF THE INVENTION

Accordingly, this invention provides extenders, mounted on the top surface of the L-shaped leg of the top section of the hot face refractory wall, and extending thereabove, to prevent such spillage of coal during leveling and entry of spilled coal into the hollow vent space between the cold and hot face refractory walls.

DESCRIPTION OF PREFERRED EMBODIMENTS

Figure 1:
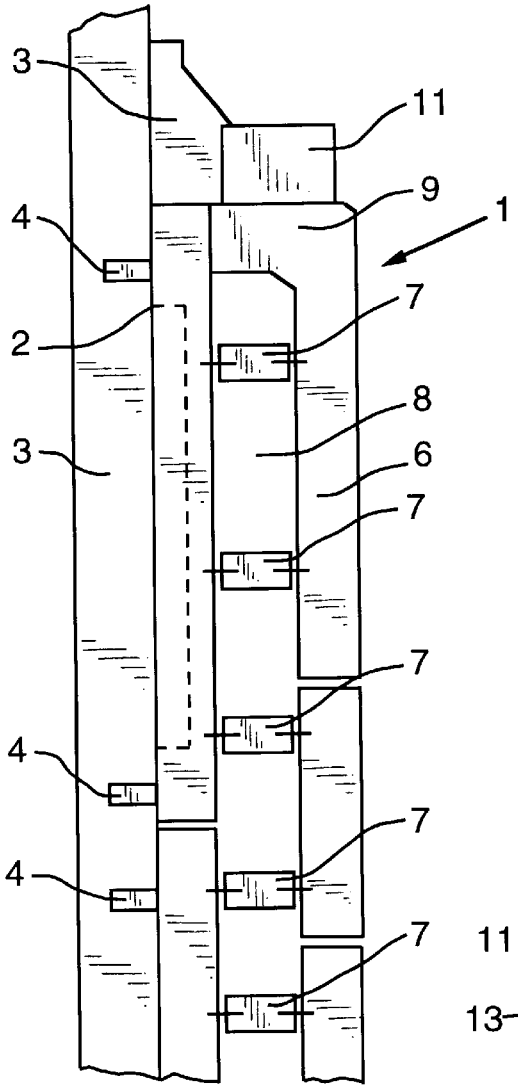
FIG. 1 is a side sectional view of the top portion of a pusher side coke oven refractory door liner of the type shown in U.S. Pat. No. 4,744,867, with one form of the extenders of the present invention mounted on the hot face refractory wall.

In FIG. 1 the numeral 1 generally denotes a coke oven door liner comprising a cold face refractory wall 2 attached to a coke oven door 3 by means of bolts 4 and a hot face refractory wall 6 connected to and spaced from the cold face refractory wall 2 by spacer bars 7, providing a hollow gas vent space 8. The top section of hot face refractory wall 6 is L-shaped, with a leg 9 extending across space 8 to abut the cold face refractory wall 2. An extender plate 11 is shown mounted on leg 9 and projecting vertically thereabove.

Figure 2:
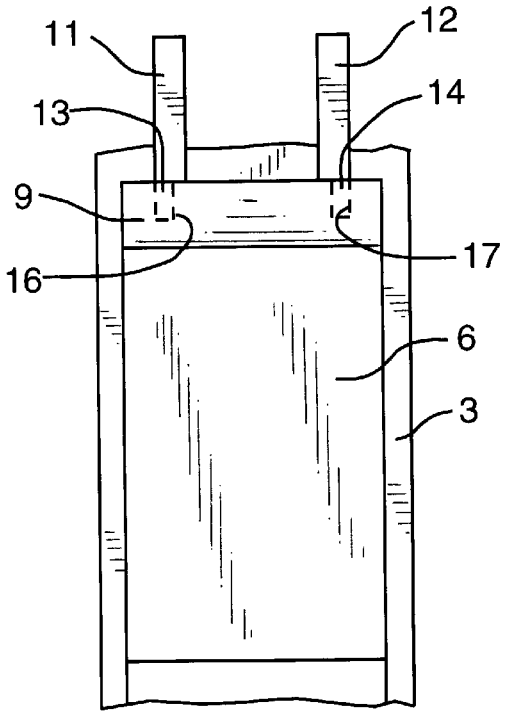
FIG. 2 is a front elevational view of the hot face refractory wall of FIG. 1, showing a pair of FIG. 1-type extenders mounted on the top surface of the top section of the hot face refractory wall.
Figure 3B:
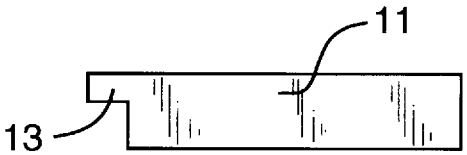
FIG. 3B is a side elevational view of the extender plate of FIG. 3A.
Figure 3A:
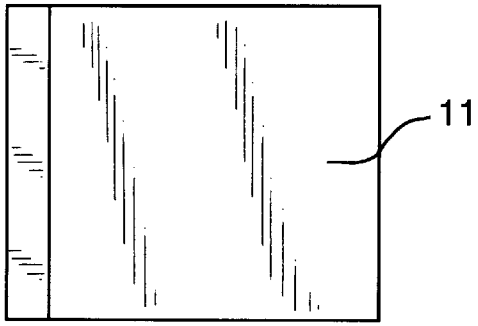
FIG. 3A is a top plan view of a right hand side extender plate as shown in FIG. 1.
Figure 4B:
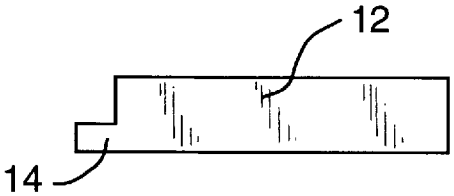
FIG. 4B is a side elevation of the extender plate of FIG. 4A.
Figure 4A:
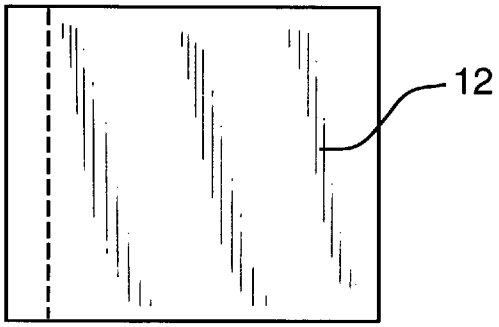
FIG. 4A is a top plan view of a left hand side extender plate as shown in FIG. 1.

FIG. 2 presents an end view of extenders 11 and 12 mounted on leg 9 and extending above the top surface of the hot face refractory wall 6.

As shown in FIGS. 3A, 3B, 4A and 4B, the extender plates 11 and 12 may have off-set or tongue portions 13 and 14, respectively, extending along one edge of the plate. L-shaped leg 9 has a pair of preformed slots 16 and 17 in which off-set portions 13 and 14 of extender plates 11 and 12 are mounted and fixed, as by mortaring.

Extender plates 11 and 12 may be constructed of any suitable material, for example a stainless steel or, preferably a refractory material such as that described in U.S. Pat. No. 5,120,477, and effectively prevent coal from spilling over the sides of the top of the hot refractory wall during coal leveling, and thus aid in keeping hollow vent space 8 free from plugging.

Figure 5:
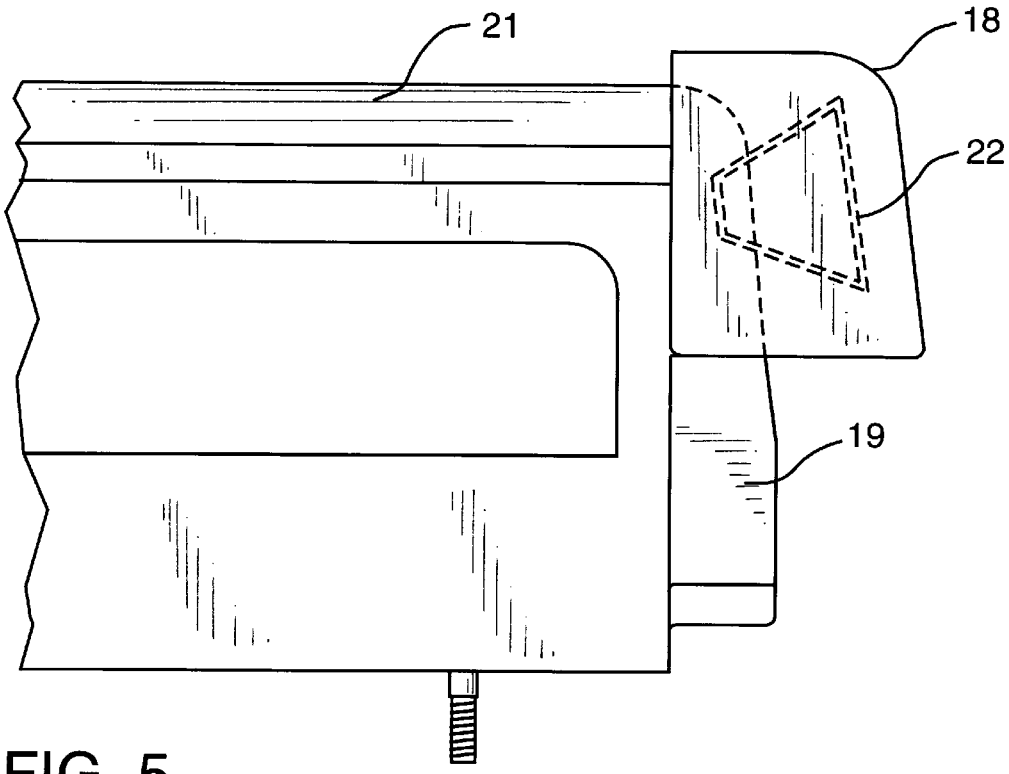
FIG. 5 is a side elevation of another form of extender plate of the invention.
Figure 6:
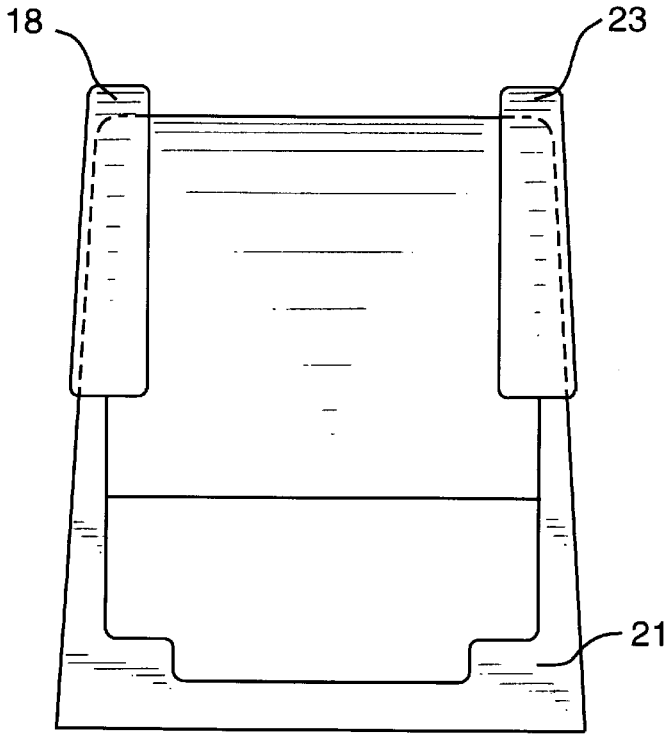
FIG. 6 is an end elevation of the extender plate of FIG. 5.

Another, preferred, form of the extender plates of the invention is shown in FIGS. 5 and 6. FIG. 5 shows, in side elevation, an extender plate 18 integrally cast with a castable refractory forming the L-shaped leg 19 of a hot face refractory wall 21 of a pusher side door plug. As seen in FIG. 5, the extender plate 18 may extend along only a part of the length of the leg 19, and may comprise an internal structure or reinforcing element 22 of any suitable form which may be connected to the internal metal components of the cast plug. As shown in end elevation in FIG. 6, extender plates 18 and 23, both integrally cast with the hot refractory wall 21, extend above the top surface of that wall to protect against coal from entering the space between that wall and the cold refractory wall.

What is claimed is:

1. In a coke oven pusher side door assembly of the type having a door, a cold face refractory wall attached to the door, a hot face refractory wall attached to and spaced from the cold face refractory wall and having a top section of L-shape having a horizontally-disposed leg extending across the space between the cold face wall and the hot face wall, the improvement comprising a pair of extender plates mounted on a top surface of the leg and extending vertically thereabove to prevent coal spillage and entry into the space between the cold face wall and the hot face wall during coal levelling.

2. A coke oven pusher side door assembly according to claim 1, wherein the extender plates are integrally cast with a castable refractory forming the hot face wall.

3. A coke oven pusher side door assembly according to claim 2, wherein the cast extender plates contain an internal metal reinforcing member.

4. A coke oven pusher side door assembly according to claim 1, wherein the leg of the hot face refractory wall is provided with a pair of preformed grooves, and each extender plate is provided with one edge having an off-set portion forming a tongue adapted to fit in one of the grooves for mounting the plate on the hot face refractory wall.

5. A coke oven pusher side door assembly according to claim 4, wherein the tongues of the extender plates are mortared into the grooves of the leg of the hot face refractory wall.

6. A coke oven pusher side door assembly according to claim 5, wherein the extender plates are constructed of a refractory material.

* * * * *